US009064384B2

(12) United States Patent
Gao et al.

(10) Patent No.: US 9,064,384 B2
(45) Date of Patent: Jun. 23, 2015

(54) GOODS TRANSMISSION SYSTEM

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Zhi-Yong Gao, Wuhan (CN); Yu-Lin Liu, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 121 days.

(21) Appl. No.: 13/973,728

(22) Filed: Aug. 22, 2013

(65) Prior Publication Data

US 2014/0190984 A1 Jul. 10, 2014

(30) Foreign Application Priority Data

Jan. 8, 2013 (CN) ..... 2013 1 00058807

(51) Int. Cl.
*G07F 11/32* (2006.01)
*G07F 11/42* (2006.01)

(52) U.S. Cl.
CPC ..... *G07F 11/42* (2013.01); *G07F 11/32* (2013.01)

(58) Field of Classification Search
CPC ..... G07F 11/32; G07F 11/28; G07F 11/36; G07F 11/42
USPC ..... 221/92, 133
See application file for complete search history.

(56) References Cited

U.S. PATENT DOCUMENTS

| | | | | | |
|---|---|---|---|---|---|
| 2,302,166 | A * | 11/1942 | Anthony | 221/133 |
| 2,837,237 | A * | 6/1958 | Stewart | 221/11 |
| 3,263,857 | A * | 8/1966 | Krakauer et al. | 221/85 |
| 4,108,333 | A * | 8/1978 | Falk et al. | 221/13 |
| 5,064,341 | A * | 11/1991 | Pippin | 414/797.6 |
| 6,095,369 | A * | 8/2000 | Jenkins et al. | 221/77 |
| 8,757,434 | B2 * | 6/2014 | Roekens et al. | 221/97 |
| 2003/0146235 | A1 * | 8/2003 | Peeler, Jr. | 221/123 |
| 2009/0152288 | A1 * | 6/2009 | Guglielmi et al. | 221/13 |
| 2010/0072221 | A1 * | 3/2010 | Chirnomas | 221/211 |

* cited by examiner

*Primary Examiner* — Patrick Mackey
(74) *Attorney, Agent, or Firm* — Novak Druce Connolly Bove + Quigg LLP

(57) ABSTRACT

A goods transmission system in a vending machine includes a vending cabinet and a goods output mechanism. A supporting plate with a cutout blocks goods from falling in the cabinet. The supporting plate bears against an upwardly-inclined bottom plate which, with separating plates, carries a plurality of goods. A plurality of first resisting brackets and a plurality of second resisting brackets on an endless toothed belt extend from the drive member and the drive member drives the plurality of first resisting brackets and the second resisting brackets around. The action of the first resisting brackets and the second resisting brackets push the plurality of goods to move on the supporting plate until one of the plurality of goods is pushed to being above the cutout and the item drops from the cutout for the customer.

18 Claims, 3 Drawing Sheets

GOODS TRANSMISSION SYSTEM

BACKGROUND

1. Technical Field

The present disclosure relates to a goods transmission system in vending machines.

2. Description of Related Art

Vending machines include goods channels for accommodating a plurality of sale items. Typical vending machines use motors to push the goods to output trays, and customers can get the goods from the output trays. Motors usually respond slowly and may not push the correct items to the output trays.

Therefore, there is a need for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
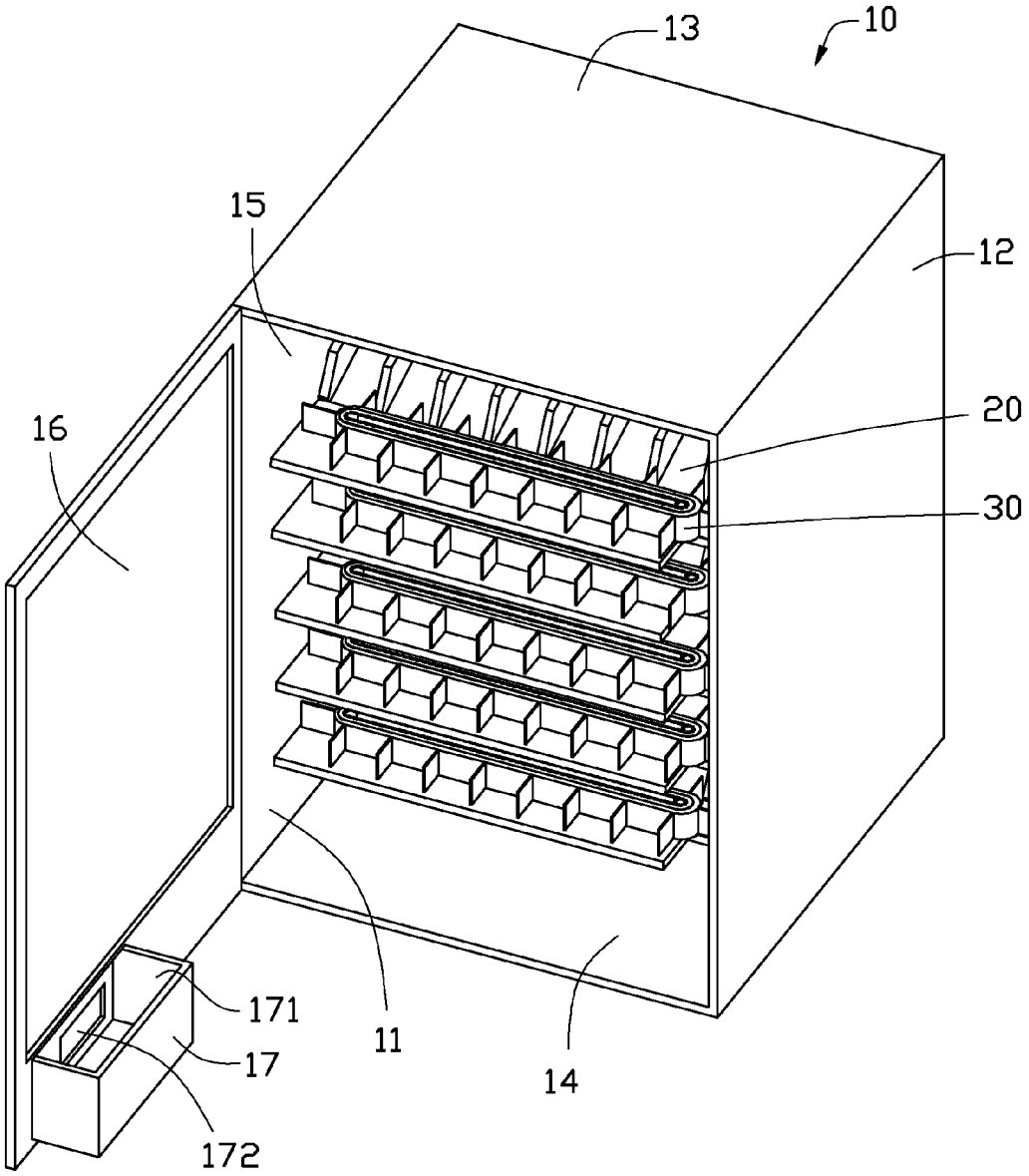
FIG. 1 is an isometric view of an embodiment of a goods transmission system; the goods transmission system includes a goods output member and a driving member.

FIG. 1 shows a goods transmission system in a vending machine which includes a cabinet 10 and a plurality of goods output members 20 located in the cabinet 10.

The cabinet 10 includes a first sidewall 11, a second sidewall 12, a top wall 13, and a bottom wall 14. The first sidewall 11, the second sidewall 12, the top wall 13, and the bottom wall 14 corporately form an accommodating space 15 therebetween. The first sidewall 11 is parallel to the second sidewall 12. The top wall 13 is parallel to the bottom wall 14. The top wall 13 and the bottom wall 14 are connected to the first sidewall 11 and the second sidewall 12. A door 16 is pivotably mounted on the first sidewall 11. An accommodating box 17 is mounted at a corner of the door 16. The accommodating box 17 defines a first opening 171 at a top for receiving goods. The accommodating box 17 defines a second opening 172 on one side for a customer to pick up purchased goods. The second opening 172 is defined in the door 16 and communicates with an outside of the cabinet 10.

Figure 2:
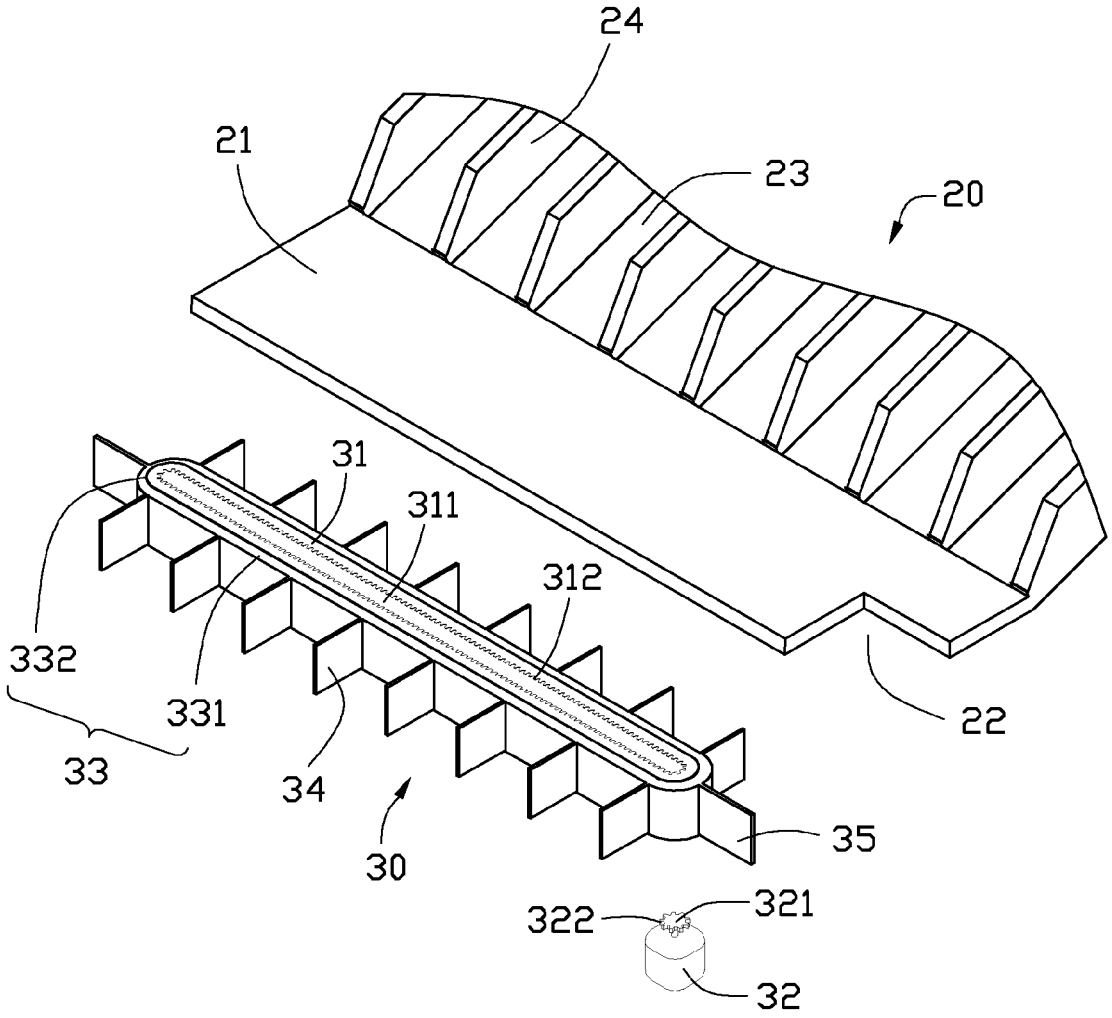
FIG. 2 is an isometric, exploded view of the goods output member and the driving member of FIG. 1.

FIG. 2 shows that each of the plurality of goods output members 20 includes a supporting plate 21. A flexible drive member 30 is mounted on the supporting plate 21. A rectangular cutout 22 is defined at a corner of the supporting plate 21. An upwardly inclined plate (bottom plate 23) extends from a side edge of the supporting plate 21. A plurality of separating plates 24 substantially perpendicularly extend upwards from the bottom plate 23.

The drive member 30 includes an endless transmission chain 31. An accommodating slot 311 is formed within the transmission chain 31 when installed. A plurality of first engaging portions 312 protrude from the transmission chain 31 to an inner side of the accommodating slot 311. A motor 32 is mounted in the accommodating slot 311. A round gear 321 is mounted on a top of the motor 32. A plurality of second engaging portions 322 protrude from the periphery of the gear 321. An endless transmission band 33 is mounted to an outer side of the transmission chain 31. When installed, the transmission band 33 includes a number of supporting portions 331 along the straight outer side of the transmission band 33 and an arc-shaped connecting portion 332, connected to the supporting portions 331, at each end of the transmission band 33 when installed. The supporting portions 331 are parallel to each other. A plurality of rectangular first resisting brackets 34 substantially perpendicularly extend from each supporting portion 331. The plurality of first resisting brackets 34 are spaced from each other. A second resisting bracket 35 substantially perpendicularly extends from each connecting portion 332. In one embodiment, a distance between adjacent two of the first resisting brackets 34 is equal to a distance between adjacent two of the separating plates 24. The distance between adjacent two of the first resisting brackets 34 is equal to a length of the second resisting bracket 35. A width of the cutout 22 is greater than the distance between adjacent two of the first resisting brackets 34.

Figure 3:
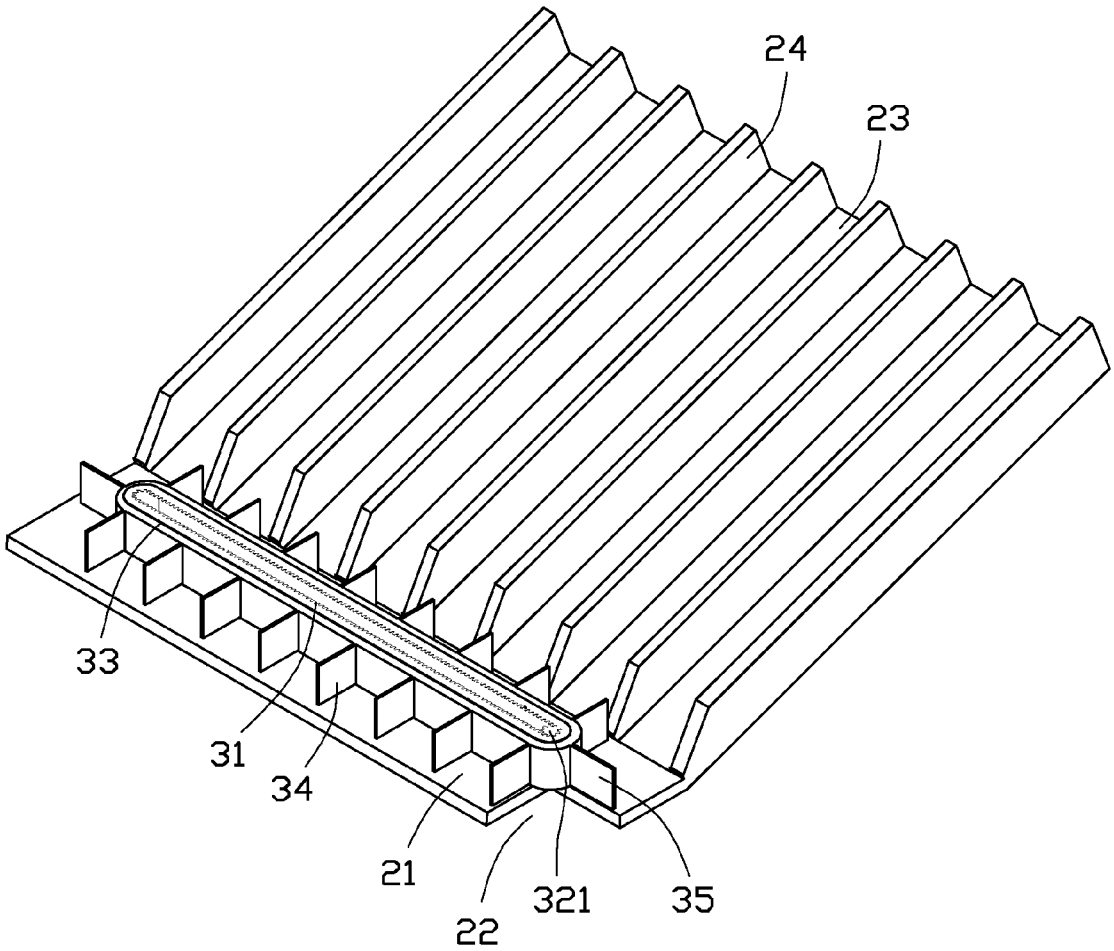
FIG. 3 is an assembled view of the goods transmission system of FIG. 2.

FIGS. 1 to 3 show that in assembly, the transmission chain 31 and the motor 32 are mounted on the supporting plate 21. The motor 32 is received in the accommodating slot 311 and located within the transmission chain 31. The plurality of first engaging portions 312 of the transmission chain 31 engage with the plurality of second engaging portions 322 of the gear 321. The transmission band 33 is mounted to the outer side of the transmission chain 31. The motor 32 is rotated such that a receiving space between adjacent two of the first resisting brackets 34 faces a receiving space between adjacent two of the separating plates 24. The drive member 30 is mounted on the goods output member 20. The goods output member 20 is located in the accommodating space 15 of the cabinet 10. The cutout 22 on the supporting plate 21 faces the first opening 171 on the top of the accommodating box 17.

In operation, a plurality of goods (not shown) are located on the bottom plate 23 between adjacent two of the separating plates 24. One of the plurality of goods between adjacent two of the separating plates 24 slides into the receiving space between adjacent two of the first resisting brackets 34. Another one of the plurality of goods between adjacent two of the separating plates 24 slides into the receiving space between the resisting bracket 34 and the second resisting bracket 35. When the motor 32 rotates, the gear 321 drives the transmission chain 31 to rotate. The transmission chain 31 drives the transmission band 33 to rotate. The plurality of resisting brackets 34 adjacent to the plurality of separating plates 24 and the resisting bracket 35 push a plurality of goods to move on the supporting plate 21 until one of the plurality of goods is pushed above the cutout 22. The goods drop into the accommodating box 17 of the door 16 from the cutout 22. Customers can get the goods from the second opening 172 in the door 16. Therefore, the possibility of malfunction of the vending machine is reduced.

Even though numerous characteristics and advantages of the present disclosure have been set forth in the foregoing description, together with details of the structure and function of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A goods transmission system, comprising:

a cabinet;

a goods output member located in the cabinet; wherein the goods output member comprises a supporting plate; a cutout is defined in the supporting plate; a bottom plate diagonally extends from a side edge of the supporting plate; a plurality of separating plates extend upwards from the bottom plate for receiving a plurality of goods therebetween; and a drive member mounted on the supporting plate; a plurality of first resisting brackets and a plurality of second resisting brackets extend from the drive member; the drive member drives the plurality of first resisting brackets and the second resisting brackets to rotate; and the plurality of first resisting brackets and the second resisting brackets push the plurality of goods to move on the supporting plate until one of the plurality of goods is pushed into the cutout and dropped from the cutout.

2. The goods transmission system of claim 1, wherein the drive member comprises a transmission chain; an accommodating slot is defined in the transmission chain; a motor is mounted in the accommodating slot on one side of the transmission chain; a gear is mounted on a top of the motor; a transmission band is mounted to an outer side of the transmission chain; and the plurality of first resisting brackets and the second resisting brackets are formed on the transmission chain.

3. The goods transmission system of claim 2, wherein the transmission band comprises two supporting portions and two connecting portions each connected to each of the two supporting portions; the plurality of first resisting brackets extend from each of the two supporting portions; the plurality of first resisting brackets are spaced from each other; and the second resisting bracket extend from each of the two connecting portions.

4. The goods transmission system of claim 3, wherein when the motor rotates, the gear drives the transmission chain to rotate, the transmission chain drives the transmission band to rotate, and the plurality of resisting brackets and the resisting bracket push the plurality of goods to move on the supporting plate.

5. The goods transmission system of claim 2, wherein a plurality of first engaging portions protrude from the transmission chain; a plurality of second engaging portions protrude from the gear; and each of the plurality of first engaging portions engages with each of the plurality of second engaging portions.

6. The goods transmission system of claim 1, wherein a distance between adjacent two of the first resisting brackets is equal to a distance between adjacent two of the separating plates; the distance between adjacent two of the first resisting brackets is equal to a length of the second resisting bracket; and a width of the cutout is greater than the distance between adjacent two of the first resisting brackets.

7. The goods transmission system of claim 1, wherein the cabinet comprises a first sidewall, a second sidewall, a top wall, and a bottom wall; the first sidewall, the second sidewall, the top wall, and the bottom wall corporately form an accommodating space therebetween; and the goods output member is located in the accommodating space.

8. The goods transmission system of claim 7, wherein a door is pivotally mounted on the first sidewall; an accommodating box is mounted on the door; the accommodating box defines a first opening at a top for receiving goods; the accommodating box defines a second opening on one side for outputting goods; and the second opening is defined in the door and accessible from outside of the cabinet.

9. The goods transmission system of claim 8, wherein the cutout on the supporting plate faces the first opening on the top of the accommodating box.

10. A goods transmission system, comprising:

a cabinet comprising an accommodating box;

a goods output member located in the cabinet; wherein the goods output member comprises a supporting plate; a cutout is defined in the supporting plate; a bottom plate diagonally extends from a side edge of the supporting plate; a plurality of separating plates extend upwards from the bottom plate for receiving a plurality of goods therebetween; and a drive member mounted on the supporting plate; a plurality of first resisting brackets and a plurality of second resisting brackets extend from the drive member; the drive member drives the plurality of first resisting brackets and the second resisting brackets to rotate; and the plurality of first resisting brackets and the second resisting brackets push the plurality of goods to move on the supporting plate until one of the plurality of goods is pushed into the cutout and dropped in the accommodating box from the cutout.

11. The goods transmission system of claim 10, wherein the drive member comprises a transmission chain; an accommodating slot is defined in the transmission chain; a motor is mounted in the accommodating slot on one side of the transmission chain; a gear is mounted on a top of the motor; a transmission band is mounted to an outer side of the transmission chain; and the plurality of first resisting brackets and the second resisting brackets are formed on the transmission chain.

12. The goods transmission system of claim 11, wherein the transmission band comprises two supporting portions and two connecting portions each connected to each of the two supporting portions; the plurality of first resisting brackets extend from each of the two supporting portions; the plurality of first resisting brackets are spaced from each other; and the second resisting bracket extend from each of the two connecting portions.

13. The goods transmission system of claim 12, wherein when the motor rotates, the gear drives the transmission chain to rotate, the transmission chain drives the transmission band to rotate, and the plurality of resisting brackets and the resisting bracket push the plurality of goods to move on the supporting plate.

14. The goods transmission system of claim 11, wherein a plurality of first engaging portions protrude from the transmission chain; a plurality of second engaging portions protrude from the gear; and each of the plurality of first engaging portions engages with each of the plurality of second engaging portions.

15. The goods transmission system of claim 10, wherein a distance between adjacent two of the first resisting brackets is equal to a distance between adjacent two of the separating plates; the distance between adjacent two of the first resisting brackets is equal to a length of the second resisting bracket; and a width of the cutout is greater than the distance between adjacent two of the first resisting brackets.

16. The goods transmission system of claim 10, wherein the cabinet comprises a first sidewall, a second sidewall, a top wall, and a bottom wall; the first sidewall, the second sidewall, the top wall, and the bottom wall corporately form an accommodating space therebetween; and the goods output member is located in the accommodating space.

17. The goods transmission system of claim 16, wherein a door is pivotally mounted on the first sidewall; the accommodating box is mounted on the door; the accommodating box defines a first opening at a top for receiving goods; the accommodating box defines a second opening on one side for outputting goods; and the second opening is defined in the door and accessible from outside of the cabinet.

18. The goods transmission system of claim 17, wherein the cutout on the supporting plate faces the first opening on the top of the accommodating box.

* * * * *